US010352027B2

(12) United States Patent
Harris

(10) Patent No.: US 10,352,027 B2
(45) Date of Patent: Jul. 16, 2019

(54) FLUSHING TOILET

(71) Applicant: Deborah Sheila Harris, Thornton (ZA)

(72) Inventor: Jonathan Toby Harris, Cape Town (ZA)

(73) Assignee: Deborah Sheila Harris, Cape Town (ZA)

( * ) Notice: Subject to any disclaimer, the term of this patent is extended or adjusted under 35 U.S.C. 154(b) by 0 days.

(21) Appl. No.: 15/521,321

(22) PCT Filed: Oct. 23, 2015

(86) PCT No.: PCT/IB2015/058190

§ 371 (c)(1),
(2) Date: Apr. 24, 2017

(87) PCT Pub. No.: WO2016/063257

PCT Pub. Date: Apr. 28, 2016

(65) Prior Publication Data

US 2017/0306601 A1 Oct. 26, 2017

(30) Foreign Application Priority Data

Oct. 24, 2014 (ZA) ..... 2014/07754

(51) Int. Cl.
*E03D 1/14* (2006.01)
*E03D 11/08* (2006.01)
(Continued)

(52) U.S. Cl.
CPC ..... *E03D 1/142* (2013.01); *E03D 1/14* (2013.01); *E03D 5/01* (2013.01); *E03D 5/09* (2013.01);
(Continued)

(58) Field of Classification Search
CPC ..... E03D 1/142
(Continued)

(56) References Cited

U.S. PATENT DOCUMENTS 5,054,133 A * 10/1991 Pickerrell ..... E03D 11/02 4/329
5,404,597 A 4/1995 Hennessy
(Continued)

FOREIGN PATENT DOCUMENTS

EP 1 526 222 A1 4/2005
EP 2 192 243 A2 6/2010
(Continued)

OTHER PUBLICATIONS

Extended European Search Report, dated Nov. 27, 2017.
(Continued)

*Primary Examiner* — Lauren A Crane
(74) *Attorney, Agent, or Firm* — Dority & Manning, P.A.

(57) ABSTRACT

A flushing toilet has a manually operable main discharge valve with a main flushing outlet connected to a flushing outlet below the normal water level in a toilet bowl water trap. The flushing outlet is directed toward the water trap. A generally tangential swirling outlet in an upper region of the toilet bowl is controlled by a separate valve and directed generally horizontally to cause water leaving it to follow a swirling path on the inside of the toilet bowl in a cleansing flush. The water trap has a passage that follows a path of generally squat U-shape with an inlet end opening into the lower end of the toilet bowl, a central region that is lowermost and a water trap outlet the lowermost part of which defines a depth to the water trap. The cross-sectional shape of the passage has a longer vertical axis than its horizontal axis.

13 Claims, 3 Drawing Sheets

(51) Int. Cl.
*E03D 5/01* (2006.01)
*E03D 5/09* (2006.01)

(52) U.S. Cl.
CPC ..... *E03D 11/08* (2013.01); *E03D 2201/30* (2013.01)

(58) Field of Classification Search
USPC ..... 4/324
See application file for complete search history.

(56) References Cited

U.S. PATENT DOCUMENTS

| | | | |
|---|---|---|---|
| 2004/0040080 | A1 | 3/2004 | Prokopenko et al. |
| 2005/0081284 | A1 | 4/2005 | Grob et al. |
| 2009/0199332 | A1 | 8/2009 | Mesun et al. |
| 2012/0284910 | A1 | 11/2012 | Shirakawa et al. |
| 2014/0196809 | A1 | 7/2014 | Klein |

FOREIGN PATENT DOCUMENTS

| | | |
|---|---|---|
| EP | 2562314 | 2/2013 |
| WO | WO 2003/014483 | 2/2003 |
| WO | WO 2013/145999 | 10/2013 |
| WO | WO 2014/078461 A2 | 5/2014 |

OTHER PUBLICATIONS

International Search Report, dated Jan. 29, 2016.
Written Opinion of International Searching Authority, dated Jan. 5, 2016.

* cited by examiner

FLUSHING TOILET

CROSS-REFERENCE(S) TO RELATED APPLICATIONS

This application claims priority from PCT International patent application no. PCT /IB2015/058190 filed on 23 Oct. 2015, which is hereby incorporated herein by this reference for all purposes.

FIELD OF THE INVENTION

This invention relates to a flushing toilet, more specifically, a flushing toilet that requires relatively little water for flushing same.

BACKGROUND TO THE INVENTION

Water is a scarce natural resource in many areas such as sub-Saharan Africa where many communities lack reliable water supplies. In areas where water is scarce, usage of traditional flush toilets, which may use from four to twelve liters of water for a single flush, is undesirable.

Toilets that flush using a relatively small volume of water are therefore highly advantageous in water scarce areas. Added to this is the fact that some sewerage treatment facilities such as septic tanks and other biodigestors can suffer reduced performance of the biological processes with increased flows of water.

Several models of low volume flush toilets are known in the prior art. One design of flushable toilet uses a 45 degree outlet and smaller diameter pipe and has a single stage flush mechanism that is similar to conventional designs with water being discharged from the rim of the toilet bowl. The design which is made from injection moulded plastic material flushes using approximately two liters of water.

Another design uses two jets of water to create a double vortex to clear the toilet bowl and also has a subsurface inlet to clear the water trap. The design requires a pump and works on about five liters of water per flush.

For the purposes of this specification the term the water trap is intended to mean the lower at generally U-shaped bend at the bottom of a toilet bowl and wherein the depth of water in the bend is determined by the vertical height of the outlet from the generally U-shaped bend. The water trap therefore has a normal water level in the horizontal plane of a bottom of the outlet from the generally U-shaped bend.

The preceding discussion of the background to the invention is intended only to facilitate an understanding of the present invention. It should be appreciated that the discussion is not an acknowledgment or admission that any of the material referred to was part of the common general knowledge in the art as at the priority date of the application.

There is a need for a flushing toilet that has a low water usage accompanied by acceptable efficiency.

SUMMARY OF THE INVENTION

In accordance with a first aspect of the invention there is provided a flushing toilet having a flushing discharge chamber that communicates by way of a manually operable main discharge valve with a main flushing outlet from the discharge chamber; the main flushing outlet being connected, in use, to a flushing outlet near a bottom of a toilet bowl wherein the flushing outlet is located below the normal water level in a water trap at the bottom of the toilet bowl and is directed toward the water trap in an entrance region thereof to effect a discharge flush; and a generally tangential swirling outlet in an upper region of the toilet bowl and that is directed generally horizontally to cause water leaving it to follow a swirling path downwards on the inside of the toilet bowl towards the water trap in a cleansing flush wherein the water trap includes a passage that follows a path of generally squat U-shape with a downwardly extending curved shape, an inlet end opening into the lower end of the toilet bowl, a central region that is lowermost and a water trap outlet the lowermost part of which defines a depth to the water trap, wherein the cross-sectional shape of the passage has a longer vertical axis than its horizontal axis.

Further features of this first aspect of the invention provide for the passage to have a forward wall that follows a path that descends at an angle of about 45° to about 65° to the horizontal, preferably about 45°, through a lowermost central region to ascend at a rearmost wall of the water trap to the water trap outlet at a steeper angle typically of about 65° to the horizontal; for the cross-sectional shape of the passage to be either oval or to have a lower part of smaller radius of curvature than an upper part to provide a cross-sectional shape that is basically of egg-shape in cross-section; for the water trap outlet to be of circular shape in cross-section for attachment to a conventional plumbing pipe; and for the main discharge valve to be arranged such that a pipe connecting the discharge valve with the flushing outlet fills with air following a flush preparatory to a subsequent flush in which the arrangement is such that air within the pipe is carried through the pipe and out of the flushing outlet ahead of water discharged during a discharge flush.

Still further features of the first aspect of the invention provide for the flushing toilet to have a flushing arrangement that includes a hollow housing defining the discharge chamber within the housing; for the manually operable main discharge valve to be arranged to discharge the entire contents of the discharge chamber once it has been operated; for the discharged volume to be selected to result in effective clearing of material in and around the water trap; for an auxiliary valve to be provided for the generally tangential swirling outlet in an upper region of the toilet bowl; for the auxiliary valve to be manually operable; for the two valves to be the two valves of a dual action valve assembly; and for there to be a diverter valve for directing a smaller flush towards the generally tangential swirling outlet and a larger flush towards the main flushing outlet.

The flushing action of the flushing toilet defined above is largely dependent on the shaping of the inside surface of the toilet bowl and a preferred shape has a forward surface to the toilet bowl that is optionally slightly convex and is downwardly inclined rearwards to merge smoothly with a lowermost surface of the water trap such that the toilet bowl has a continuous surface that slopes downwards towards a smoothly curved water trap and then curves upwards on the outlet side of the water trap to end in a discharge outlet that determines a normal water level in the water trap without any surface discontinuities other than the main flushing outlet. The shape of the inner surface of the toilet bowl is basically that of a lopsided, inverted truncated cone or funnel with, in the vertical direction, an inclined forward surface region that may have an optional somewhat convex portion especially in an upper region thereof, and a generally upright rear surface.

In accordance with a second aspect of the invention there is provided a flushing toilet having a flushing arrangement that includes a hollow housing defining a discharge chamber within the housing and wherein the discharge chamber communicates by way of a manually operable main discharge valve with a main flushing outlet from the discharge chamber; the main flushing outlet being connected, in use, to a flushing outlet near the bottom of a toilet bowl wherein the flushing outlet is located below the normal water level in a water trap at a bottom of the toilet bowl and is directed toward the water trap in an entrance region thereof so that it is adapted to effect a discharge flush; and a generally tangential swirling outlet in an upper region of the toilet bowl and that is directed generally horizontally so that it is adapted to cause water leaving it to follow a swirling path downwards on the inside of the toilet bowl towards the water trap in a cleansing flush wherein the water trap includes a passage that follows a path of generally squat U-shape with a downwardly extending curved shape, a manually operable auxiliary valve having an outlet connected in use to the generally tangential swirling outlet in an upper region of the toilet bowl and a separately manually operable main discharge valve.

The manually operable main discharge valve and the manually operable auxiliary valve are preferably operable selectively so that they can be operated sequentially. The manually operable main discharge valve and the manually operable auxiliary valve may share a single manual operating member such that operation of the manual operating member in one way causes operation of the one valve and in another way causes operation of the other valve. The manually operable auxiliary valve may be such that it needs to be manually urged to a position corresponding to the open position for only so long as a user chooses.

Alternatively, the manually operable main discharge valve and the manually operable auxiliary valve may be the two valves of a dual flush type of cistern discharge valve assembly in which Instance a flow diverter valve is used in combination with it so that a smaller flush is directed towards the generally tangential swirling outlet and the discharge flush is directed towards the pipe connected to the main flushing outlet. In such an instance the manually operable main discharge valve and the manually operable auxiliary valve are typically operated by pushbuttons on the top of a cistern and they can be operated sequentially as may be required. The operating mechanisms are associated with the flow diverter valve such that the smaller flush is directed towards the generally tangential swirling outlet and a discharge flush is directed towards the pipe connected to the main flushing outlet. The diverter valve preferably includes a diverter flap having a first and a second terminal position for selectively directing flushing water towards either the main flushing outlet or the generally tangential swirling outlet and a mechanism is provided for automatically moving the diverter flap to its appropriate terminal position.

The toilet may be made of any suitable material such as a glazed ceramic material or a plastic material with a preference being for a glazed ceramic material from which waste material can generally be more easily flushed and which is less prone to soiling and wear.

In order that the above and other features of the invention may be more fully understood different embodiments of the invention will now be described with reference to the accompanying drawings.

DETAILED DESCRIPTION WITH REFERENCE TO THE DRAWINGS

Figure 1:
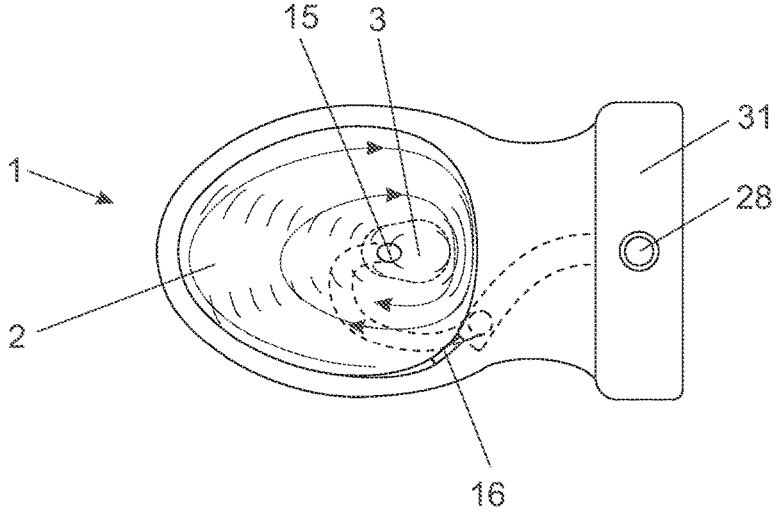
FIG. 1 is a schematic plan view of one embodiment of toilet according to the Invention.
Figure 2:
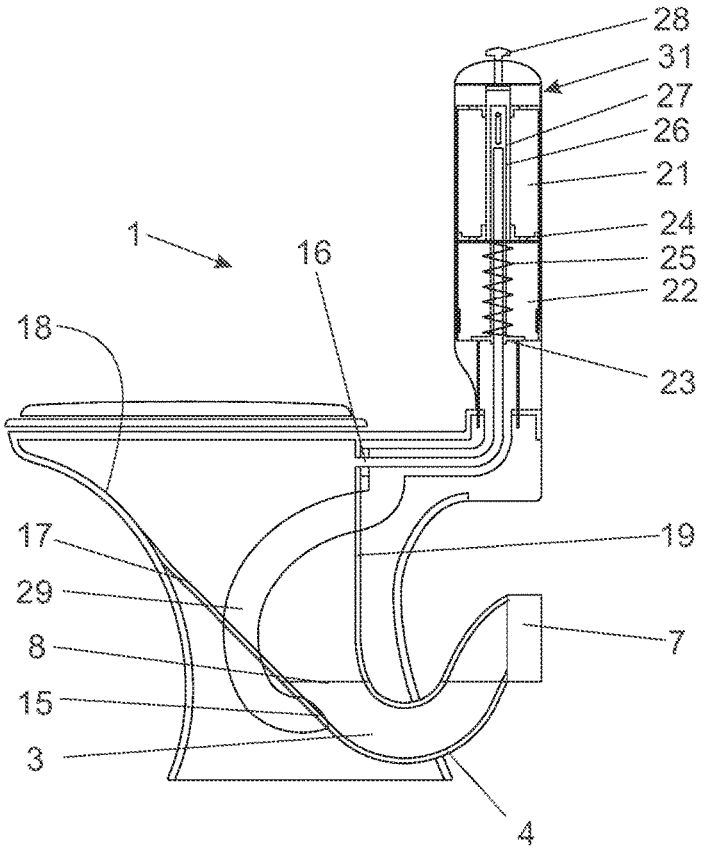
FIG. 2 is a schematic sectional side view thereof.
Figure 3:
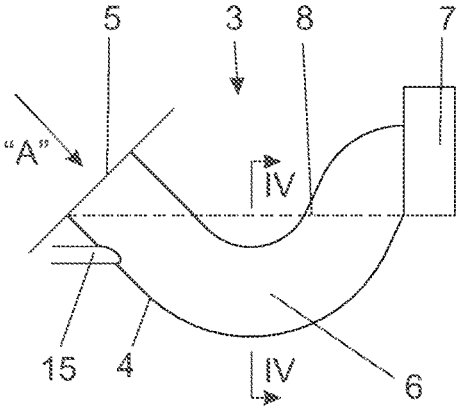
FIG. 3 is a schematic side view of the water trap of the toilet illustrated in FIGS. 1 and 2.

In the embodiment of the invention illustrated in FIGS. 1 to 3 of the drawings, a flushing toilet (1) has a toilet bowl (2) with a water trap (3) at the bottom of the bowl.

With particular reference to FIG. 3, the water trap has a passage (4) that follows a path of generally squat U-shape with a downwardly extending curved shape, an inlet end (5) opening into the lower end of the toilet bowl, a central region (6) that is lowermost and an outlet end (7) the lower extremity of which defines a depth to the water trap that is indicated by the water level (8).

In this embodiment of the invention the passage follows a path in which the forward surface descends towards the lowermost central region of the water trap at an angle of between about 45° and 65° to the horizontal, 45° presently being favoured; passes through a smooth curve that defines the lowermost central region; and ascends to the outlet at an angle of about 65° to the horizontal in order to provide for ease of solid waste material being conveyed through the water trap.

Figure 4:
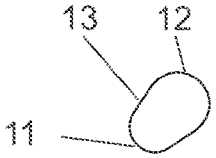
FIG. 4 illustrates the cross-sectional shape of the passage at its inlet end in the direction shown by arrow "A" in FIG. 3 and that is the same in the centre of the water trap along line IV to IV in FIG. 3.
Figure 5:
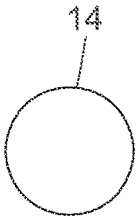
FIG. 5 illustrates the cross-sectional shape of the passage at its discharge end.

Also, to assist in the flushing action using a small volume of water through the passage that passes through the water trap, the cross-sectional shape of the passage is longer in the vertical direction than it Is in the horizontal direction. In fact, in this embodiment of the invention, the cross-section of the passage has a lower part (11) of smaller radius of curvature than the upper part (12) to provide a cross-sectional shape that is basically of an egg-shape in cross-section, as indicated by numeral (13) in FIG. 4 whilst the outlet end of the water trap is of circular shape in cross-section, as indicated by numeral (14) in FIG. 5 for attachment to a conventional plumbing pipe.

Whilst the exact dimensions of the passage can be varied somewhat, one arrangement that has been proposed has a smaller dialiter lower part with a dialiter of about 40 mm and a larger dialiter upper part with a dialiter of about 50 mm and an overall height of 70 mm that gives a cross-sectional area for flow of about 3200 $mm^2$. The circular cross-sectioned outlet itself may have a cross-sectional area for flow of about 7800 $mm^2$. The result is a water trap having a capacity of less than 1 liter and preferably about 0.6 liter.

Figure 6:
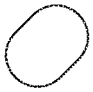
FIG. 6 illustrates an alternative cross-sectional shape of the passage through the water trap at its inlet end and central region.
Figure 8:
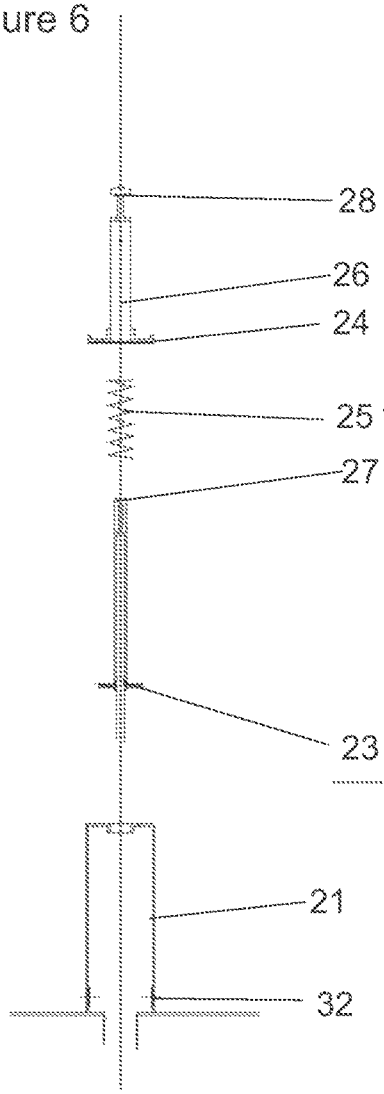
FIG. 8 is an exploded illustration of the components of the combination integrated valve assembly illustrated in FIG. 7

An alternative upright oval cross-sectional shape is also possible, as illustrated in FIG. 6.

The toilet has a flushing outlet (15) that is to be submerged in water in the water trap in use in an entrance region of the water trap and that is directed toward the water trap itself such that air or water leaving the flushing outlet flows into the water trap and towards the outlet from the water trap so that solid materials within the water trap will be flushed towards the outlet.

The toilet also has a generally tangential swirling outlet (16) in an upper region of the toilet bowl and that is directed generally horizontally.

The shape of the toilet bowl is generally that of an inverted cone or funnel and is selected to cause the flow velocity of water introduced by way of the tangential swirling outlet to increase as it moves towards the water trap that is generally in the centre of the width of the bowl, thereby giving effective cleaning performance to remove paper and smears. The form of the toilet obviates the need for a rim and thus makes it easier to clean and more hygienic.

The flushing action of the flushing toilet described above is largely dependent on the shaping of the inside surface of the toilet bowl and a preferred shape has a forward surface (17) to the toilet bowl that is optionally slightly convex at least in its upper region and is downwardly inclined rearwards to merge smoothly with a lowermost surface of the water trap (3) such that the toilet bowl has a continuous surface that slopes downwards towards the smoothly curved water trap and then curves upwards on the outlet side of the water trap to end in a discharge outlet that determines a normal water level in the water trap without any surface discontinuities other than the main flushing outlet. The shape of the inner surface of the toilet bowl is basically that of a lopsided, inverted, truncated cone or funnel with, in the vertical direction, a rearwards and downwards inclined forward surface region (17) that may have an optional somewhat convex portion (18), and a generally upright rear surface (19).

Turning now to the flushing arrangement, in one embodiment of the invention an upright tubular housing (21) defines a discharge chamber (22) in its lower region that communicates with a manually operable main discharge valve (23) for supplying flushing water to the flushing outlet (15) that opens into the water trap at the bottom of the toilet bowl.

An integrated valve assembly includes a plunger (24) axially movable within the tubular housing and biased by means of a coaxial spring (25) toward a median rest position in which the discharge chamber is full with the main flushing outlet valve being at the bottom of the discharge chamber. The main flushing outlet valve is operable by lifting an upright axially movable tubular operating member (26).

An auxiliary valve is of an overflow type in this instance in which an overflow outlet (27) may be moved into communication with the discharge chamber by way of the tubular operating member and is arranged to be operated by depressing that same operating member (26).

The manually operable auxiliary valve has an outlet connected in use to the generally tangential swirling outlet (16) that is directed generally horizontally to cause water leaving it to follow a swirling path downwards on the inside of the toilet bowl towards the water trap in a cleansing flush.

The manually operable main discharge valve and the manually operable auxiliary valve thus share an operating handle (28) carried on the upper end of the tubular operating member such that operation of the handle in one way, namely by lifting it, causes operation of the manually operable main discharge valve (23), and urging it in the opposite direction, namely downwards, causes operation of the auxiliary valve that is an overflow valve to discharge water to the generally tangential swirling outlet (16). The manually operable auxiliary valve is thus such that it can be manually urged towards a position corresponding to the open position for only as long as a user chooses and with some additional manually applied pressure.

The manually operable main discharge valve, on the other hand, is arranged to discharge water under the action of gravity, either the entire contents of the discharge chamber, or a measured volume once it has been operated. The volume of the discharge chamber is thus selected to result in effective clearing of material in and around the water trap in use and in all events, is generally of the order of 1 liter or somewhat less.

In either event, the main discharge valve is arranged so that a pipe (29) connecting the main discharge valve with the flushing outlet (15) becomes full with air before the discharge valve closes as it is considered that an initial burst of air flowing through the pipe ahead of the water when flushing is commenced contributes significantly towards the flushing action effected by the limited amount of water used.

Figure 7:
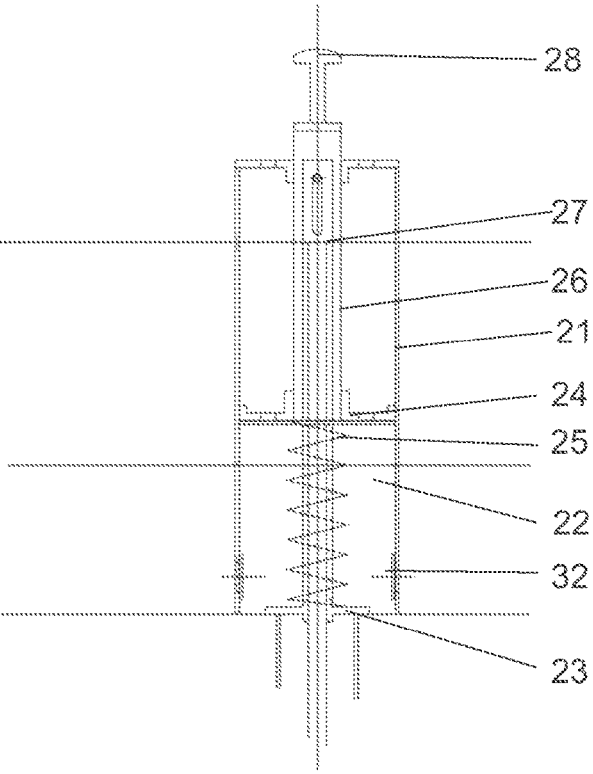
FIG. 7 is a schematic sectional elevation of a combination integrated valve assembly that can be used in the toilet illustrated in FIGS. 1 to 5.

The tubular housing (21) can be located in a cistern (31) (see FIG. 1) and may be provided with water inlets such as the one way valves that are indicated by numeral (32) (see FIG. 7) so that water can flow into the discharge chamber to re-fill it once it has been operated.

In this embodiment of the invention the manually operable main discharge valve and the manually operable auxiliary valve are clearly operable selectively independently of each other by virtue of the fact that they share a common operating handle that is vertically movable.

It has been found that using a flushing toilet as described above, flushing can be achieved using less than 1 liter of water. That compares very favourably with 4 to 6 liters of water for many modern toilets and about 2 liters for the more water sparing toilets.

The toilet provided by this invention is extremely versatile and can be connected onto a waterborne sewerage system if required or may be connected to a variety of on-site or decentralized wastewater treatment systems, as indicated above.

The flush mechanism described above enables a user to select an appropriate mode of flushing. The user can depress the operating handle to manually pressurize water in the discharge chamber to cause water to flow out of the overflow outlet, through the generally tangential swirling outlet (16), and thereby clear the toilet bowl.

This water is released from the single swirling outlet which directs the water from the back of the top of the toilet bowl in a swirling motion that is designed to fully wet the bowl and remove debris. The water naturally accelerates towards the water trap due to the shape of the bowl and this higher velocity flow provides a better cleaning action. The user can repeat this action if further cleaning of the bowl is required. Alternatively, the user can release the operating handle just as soon as the pan is clear to minimize water use.

Once the bowl is clear, the user may lift the operating handle to release a gush of water directly into the main flushing outlet at the water trap. This gush pushes out a volume of air that occupies the pipe in the rest position to provide initial clearing of the water trap, before the gush of water arrives to complete the flush and replenish the water seal. The submerged flushing outlet also uses, at least to some extent, the venturi principle to clear the dirty water from the water trap.

The 45° entry and long radius bend of the water trap enables waste to be flushed with minimal effort. The inverted egg shaped cross-sectional profile of the passage in the water trap significantly reduces the water seal volume without compromising conveyance capacity. The toilet does not require mechanical pumps to utilize the benefit of pressure in a flush. The swirling motion and submerged main flushing outlet reduce turbulence and splashing which can contribute to the release of bacteria into the air in a conventional flush.

It will be understood that numerous variations may be made to the embodiment of the invention described above without departing from the scope hereof. For example, the operating handle may assume a different form from that described above and may in fact be in the form of a lever. In that instance the movement of the handle may be different from that described above and the handle could be moved in the opposite direction to that described above. Also, the toilet may be arranged to be used with a water mains supply in which instance pressure from the supply may be used directly to supply water to the swirling outlet rather than relying on a small elevated pressure created manually. Furthermore, the details of the valve assembly may be changed widely provided that the two types of flushing are provided.

Alternatively, as indicated above, the manually operable main discharge valve and the manually operable auxiliary valve may be the two valves of a dual flush type of cistern discharge valve assembly indicated generally by numeral (40). In such an instance a flow diverter valve (41) that is illustrated schematically in FIGS. 9 and 10, is used in combination with the dual flush valve assembly so that a smaller flush Is directed towards an outlet (42) connected to the generally tangential swirling outlet and the larger discharge flush is directed towards the pipe (43) connected to the main flushing outlet.

In such an instance the manually operable main discharge valve and the manually operable auxiliary valve are typically operated by pushbuttons (44, 45) on the top of a cistern and they can be operated sequentially as may be required.

Figure 9:
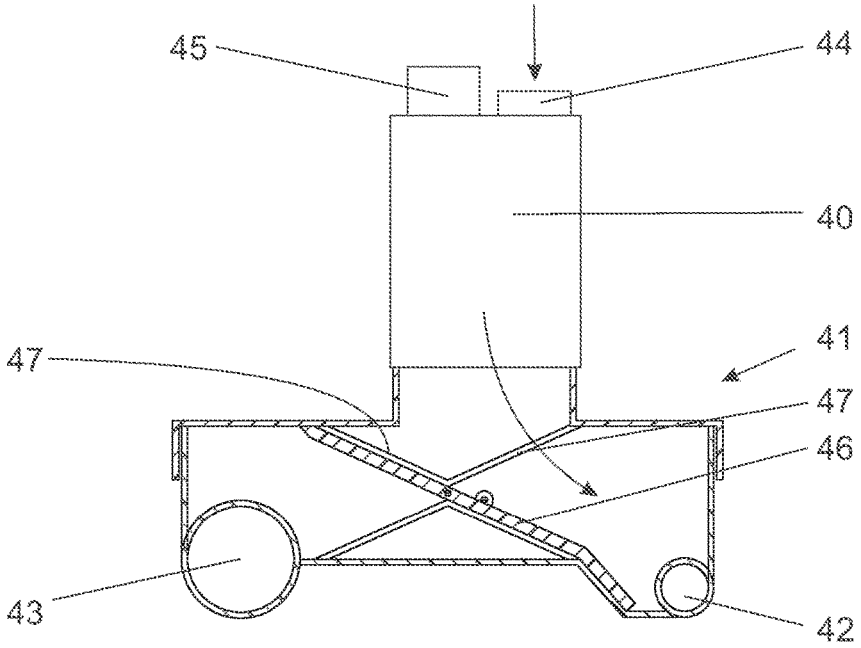
FIG. 9 is a schematic sectional elevation of a diverter valve with its diverter flap in one terminal position; and, FIG. 10 is the same as FIG. 9 with the diverter valve with its diverter flap in the other terminal position.
Figure 10:
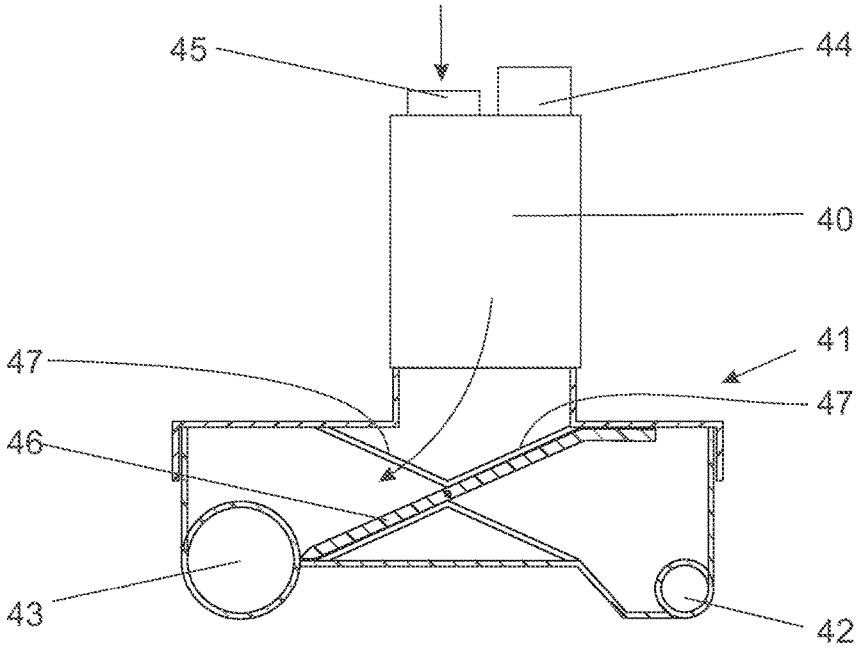

A flow diverter valve is provided such that the smaller flush, that may for example be of the order of about 300 milliliters, is directed towards the generally tangential swirling outlet, as illustrated by the position of a horizontally pivoting diverter flap (46) in its one terminal position as illustrated in FIG. 9. A larger discharge flush that may be of the order of 700 milliliters, is on the other hand, directed by the horizontally pivoting diverter flap (46) in its other terminal position, as illustrated in FIG. 10. The pushbutton operated mechanism for the main flush is coupled to the diverter valve assembly so that the diverter flap is only moved to its second terminal position when the push button associated with the main flush is operated. The diverter flap is pivoted such that it is gravitationally biased towards its first terminal position. Co-operant stop formations (47) arrest movement of the diverter flap in each of its terminal positions.

Numerous other possibilities are within the scope hereof.

Throughout the specification and claims unless the contents requires otherwise the word 'comprise' or variations such as 'comprises' or 'comprising' will be understood to imply the inclusion of a stated integer or group of integers but not the exclusion of any other integer or group of integers.

The invention claimed is:

1. A flushing toilet comprising:

a toilet bowl defining an interior surface having an upper region and a bottom disposed vertically beneath the upper region;

a swirling outlet connected to and opening into the upper region of the toilet bowl and configured and disposed so as to discharge efflux therefrom in a direction generally tangentially to the interior surface of the upper region of the toilet bowl;

a water trap disposed beneath the bottom of the toilet bowl and defining a passage that includes an inlet end spaced apart in a longitudinal direction, which is perpendicular to the vertical direction, from an outlet end and being connected to the outlet end by a central region, wherein the inlet end connects to and opens into the bottom of the toilet bowl, the passage defining a hollow interior that follows in the longitudinal direction from the inlet end to the outlet end through a path of squat U-shape with a curvature extending vertically downwardly from the inlet end to the central region and vertically upwardly from the central region to the outlet end, wherein the inlet end and central region of the passage have a constant cross-sectional shape, wherein the cross-sectional shape of the passage defines a first axis and a second axis, each axis being perpendicular to the longitudinal direction and perpendicular to each other, wherein the first axis is longer than the second axis, and wherein at least the inlet end and central region of the passage are orientated such that the longer first axis is parallel to the vertical direction;

a flushing discharge chamber disposed above the upper region of the toilet bowl and configured to store water for flushing the toilet and defining a main flushing outlet, the main flushing outlet being connected to a flushing outlet that is connected to the water trap between the inlet end of the passage and the central region of the passage; and a main discharge valve configured for controlling release of water from the flushing discharge chamber through the main flushing outlet.

2. A flushing toilet as claimed in claim 1, wherein the passage has a forward wall that follows a path that descends at an angle of between about 45° and 65° to the horizontal, through a lowermost central region to ascend as a rearmost wall of the water trap outlet at an angle of about 65° to the horizontal.

3. A flushing toilet as claimed in claim 1, wherein the cross-sectional shape of the passage has a lower part of smaller radius of curvature than an upper part to provide a cross-sectional shape that is basically of egg-shape in cross-section.

4. A flushing toilet as claimed in claim 1, wherein the passage defines a cross-sectional shape with an upper part contiguous with a lower part that is a mirror image of the upper part having substantially the same radius of curvature so as to provide a substantially upright oval cross-sectional shape.

5. A flushing toilet as claimed in which claim 1, wherein the water trap outlet is of circular shape in cross-section such that it is adapted for attachment to a conventional plumbing pipe.

6. A flushing toilet as claimed in claim 1, wherein a manually operable auxiliary valve is provided for the generally tangential swirling outlet in an upper region of the toilet bowl.

7. A flushing toilet as claimed in claim 1, wherein the inside surface of the toilet bowl is basically that of an inverted, truncated cone that is optionally lopsided with, in the vertical direction, a rearwards and downwards inclined forward surface that is optionally slightly convex, and a generally upright rear surface.

8. A flushing toilet as claimed in claim 7, wherein the rearwards and downwards inclined forward surface merges smoothly with a lowermost surface of the water trap such that the toilet bowl has a continuous surface that includes a forward surface that slopes downwards towards a smoothly curved water trap and then curves upwards on the outlet side of the water trap to end in a discharge outlet the lower extremity of which determines a normal water level in the water trap without any surface discontinuities other than the main flushing outlet.

9. A water trap for a flushing toilet having a toilet bowl defining an interior surface having an upper region and a bottom disposed vertically beneath the upper region and a flushing discharge chamber disposed above the upper region of the toilet bowl and configured to store water for flushing the toilet, the water trap comprising:

a body defining a passage that includes an inlet end spaced apart in a longitudinal direction from an outlet end and being connected to the outlet end by a central region, wherein the inlet end connects to and opens into the bottom of the toilet bowl and the outlet end connects to a plumbing pipe, the passage defining a hollow interior that follows in the longitudinal direction from the inlet end to the outlet end through a path of squat U-shape with a curvature extending vertically downwardly from the inlet end to the central region and vertically upwardly from the central region to the outlet end, wherein the inlet end and central region of the passage have a constant cross-sectional shape, the cross-sectional shape of the passage defines a first axis and a second axis, each axis being perpendicular to the longitudinal direction and perpendicular to each other, wherein the first axis is longer than the second axis, and wherein at least the inlet end and central region of the passage are orientated such that the longer first axis is parallel to the vertical direction.

10. A water trap as claimed in claim 9, wherein the passage has a forward wall that follows a path that descends at an angle of between about 45° and 65° to the horizontal, through a lowermost central region to ascend as a rearmost wall of the water trap outlet at an angle of about 65° to the horizontal.

11. A water trap as claimed in claim 9, wherein the cross-sectional shape of the passage has a lower part of smaller radius of curvature than an upper part to provide a cross-sectional shape that is basically of egg-shape in cross-section.

12. A water trap as claimed in claim 9, wherein the passage defines a cross-sectional shape with an upper part contiguous with a lower part that is the mirror image of the upper part having substantially the same radius of curvature so as to provide a substantially upright oval cross-sectional shape.

13. A water trap as claimed in claim 9, wherein the water trap outlet is of circular shape in cross-section such that it is adapted for attachment to a conventional plumbing pipe.

* * * * *